US005525569A

United States Patent [19]

Chess

[11] Patent Number: 5,525,569

[45] Date of Patent: Jun. 11, 1996

[54] SELF-CONTAINED TRANSFER TAPE

[75] Inventor: Stanley C. Chess, Jerome, Id.

[73] Assignee: Moore Business Forms, Inc., Grand Island, N.Y.

[21] Appl. No.: 206,397

[22] Filed: Mar. 7, 1994

[51] Int. Cl.[6] ..... B41M 5/132

[52] U.S. Cl. ..... 503/200; 427/152; 428/41.3; 503/226

[58] Field of Search ..... 503/200, 226; 428/40, 913, 914, 447

[56] References Cited

U.S. PATENT DOCUMENTS

| | | | |
|---|---|---|---|
| 3,394,799 | 7/1968 | Ritson et al. | 206/59 |
| 3,502,497 | 3/1970 | Crocker | 117/68.5 |
| 3,554,835 | 1/1971 | Morgan | 428/198 |
| 3,926,113 | 12/1975 | Steidinger . | |
| 4,048,736 | 9/1977 | Castleman | 40/2 R |
| 4,121,856 | 10/1978 | Brunette | 292/1 R |
| 4,654,251 | 3/1987 | Okada et al. | 428/202 |
| 4,720,479 | 1/1988 | Craig et al. | 503/200 |
| 4,868,152 | 9/1989 | Foulds et al. | 503/212 |
| 5,098,759 | 3/1992 | Felix | 428/42 |
| 5,129,682 | 7/1992 | Ashby | 283/81 |
| 5,151,309 | 9/1992 | Dollinger | 428/40 |
| 5,160,778 | 11/1992 | Hashimoto et al. | 428/195 |
| 5,279,875 | 1/1994 | Juszak et al. . | |
| 5,352,155 | 10/1994 | Fahey . | |

*Primary Examiner*—B. Hamilton Hess
*Attorney, Agent, or Firm*—Nixon & Vanderhye

[57] ABSTRACT

A transfer tape having a self-imaging liner includes a first polyethylene coating or film layer on a first face of the self-imaging liner with a first silicone coating over the first polyethylene coating or film layer and a pressure sensitive adhesive on the first silicone coating. A release sheet is provided between the second face of the self-contained carbonless sheet and is covered with a second sprayed on polyethylene coating, or film layer, in turn covered by a second silicone coating. The transfer tape may be in a roll configuration with the adhesive engaging the second silicone coating. The first silicone coating may be a differential coating and applied at a weight of about 3–10 grams per square meter. The adhesive may be a hot melt adhesive or adhesive from a pre-wound tape. A business form may be constructed of a face stock and the transfer tape, the transfer tape pressure sensitive adhesive engaging the face stock, and labels may be die cut out of the business form. A CB coating may also be provided on the second silicone coating, to overlie a CF coating. The method of making transfer tape of the invention is simple yet effective.

18 Claims, 2 Drawing Sheets

Fig. 3
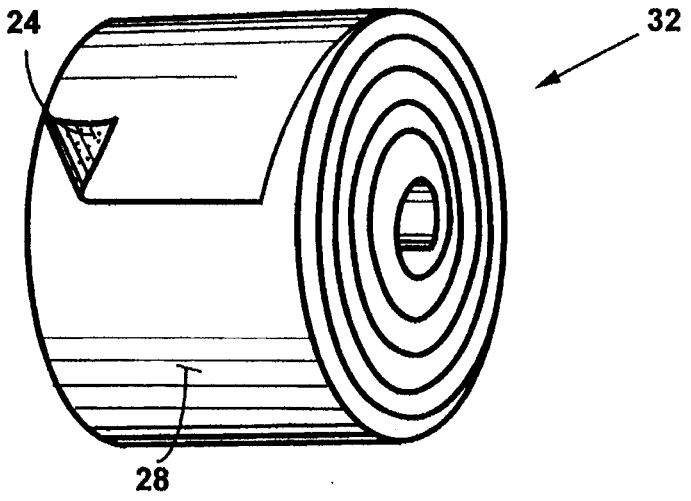
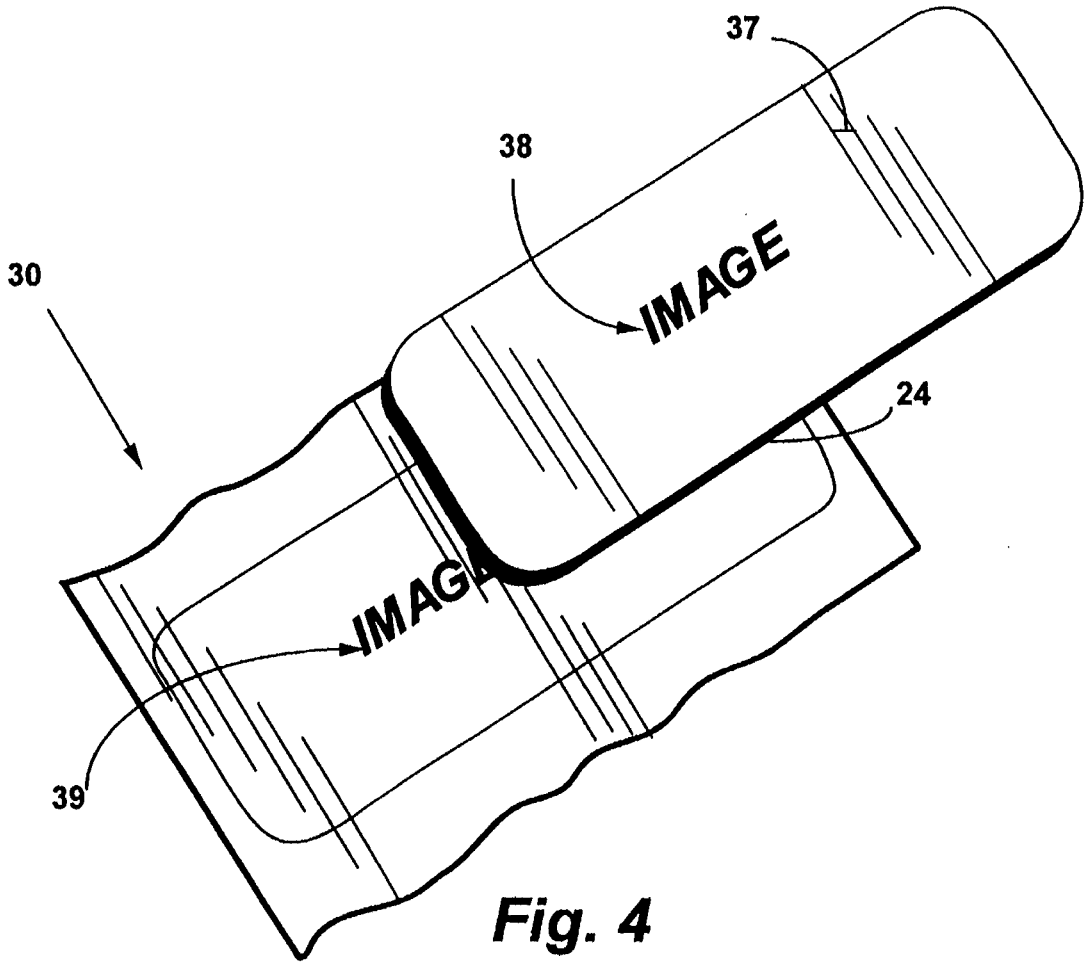
Fig. 4

SELF-CONTAINED TRANSFER TAPE

BACKGROUND AND SUMMARY OF THE INVENTION

Transfer tape is becoming increasingly common in the manufacture of business forms or the like. For example U.S. Pat. No. 5,129,682 (the disclosure of which is hereby incorporated by reference herein) shows a business form having removable labels associated therewith which is constructed by applying a piece of transfer tape to the back of paper stock, and then die cutting labels from the area covered by the transfer tape. There are many circumstances in which it is desirable to provide a self-imaging liner associated with transfer tape, for example in the manufacture of business forms such as shown in U.S. Pat. No. 5,129,682, or in the construction of other types of labels. The self-imaging liner allows the user to see what was printed on a label made with the transfer tape, providing a record copy.

According to a first aspect of the present invention, a transfer tape is provided with a self-imaging liner. The transfer tape comprises: A carbonless, self-contained primary sheet having first and second faces. A first polyethylene coating or film layer of about 1 mil thick, or less, on the first face. A first silicone coating over the first polyethylene coating or film layer. A pressure sensitive adhesive coating on the first silicone coating. A second polyethylene coating or film layer of about 1 mil thick, or less, on the second face. And a second silicone coating over the second polyethylene coating. Typically the second polyethylene coating is applied on the second face of the carbonless sheet. The transfer tape may consist of the primary sheet, first and second polyethylene coatings or film layers, first and second silicone coatings, and pressure sensitive adhesive, or a CB coating may be provided on the second silicone coating. The CB coating allows an image printed on the transfer tape to also transfer to a CF coated sheet positioned beneath the transfer tape.

The transfer tape may be provided in a roll configuration with the adhesive engaging the second silicone coating when in the spiral roll. A wide variety of different types of materials and weights of material may be provided, applied in different manners. However it is necessary that the polyethylene be provided as a coating and not as a film, and preferably it is sprayed on (or the equivalent). The silicone coating is typically provided at a weight of about 3–10 grams per square meter, with five gm./m$^3$ being approximately optimum, and typically is a differential coating of silicone. That is the silicone has a first side having a stronger affinity for adhesive than a second side, and the second side of the differential coating is what is engages the pressure sensitive adhesive. The pressure sensitive adhesive may typically be applied as a hot melt adhesive, or from a pre-wound tape.

The invention also comprises a business form comprising a face stock and a transfer tape, the transfer tape pressure sensitive adhesive engaging the face stock. The transfer tape which engages the face stock is as described above. Labels may be die cut out of the face stock, and matrix material removed, as in U.S. Pat. No. 5,129,682. A CF sheet may be provided underneath the transfer tape if a CB coating is provided on the second silicone coating of the transfer tape.

According to another aspect of the invention a method of making a transfer tape from a carbonless, self-contained primary sheet having first and second faces is provided. The method comprises the steps of: (a) Spraying a first polyethylene coating, or applying a polyethylene film layer, of about 1 mil thick, or less, on the first face. (b) Applying a first silicone coating over the first polyethylene coating. (c) Applying a pressure sensitive adhesive coating on the first silicone coating. (d) Spraying a second polyethylene coating, or applying a film layer, of about 1 mil thick, or less, on the second face. And, (e) applying a second silicone coating over the second polyethylene coating. There is also the further step of winding the transfer tape into a roll configuration with the pressure sensitive adhesive engaging the second silicone coating. Finally there is the optional further step of applying a CB coating over the second silicone coating.

It is the primary object of the present invention to provide a transfer tape having a self-imaging ply that is constructed in a simple straight-forward manner, and can be utilized in the construction of a business form with labels. This and other objects of the invention will become clear from an inspection of the detailed description of the invention and from the appended claims.

BRIEF DESCRIPTION OF THE DRAWINGS

FIG. 3 is a perspective schematic view of an exemplary roll of transfer tape according to the present invention; and FIG. 4 is a perspective exploded view showing a label and record copy produced from a business form utilizing the teachings of the present invention.

DETAILED DESCRIPTION OF THE DRAWINGS

Figure 1:
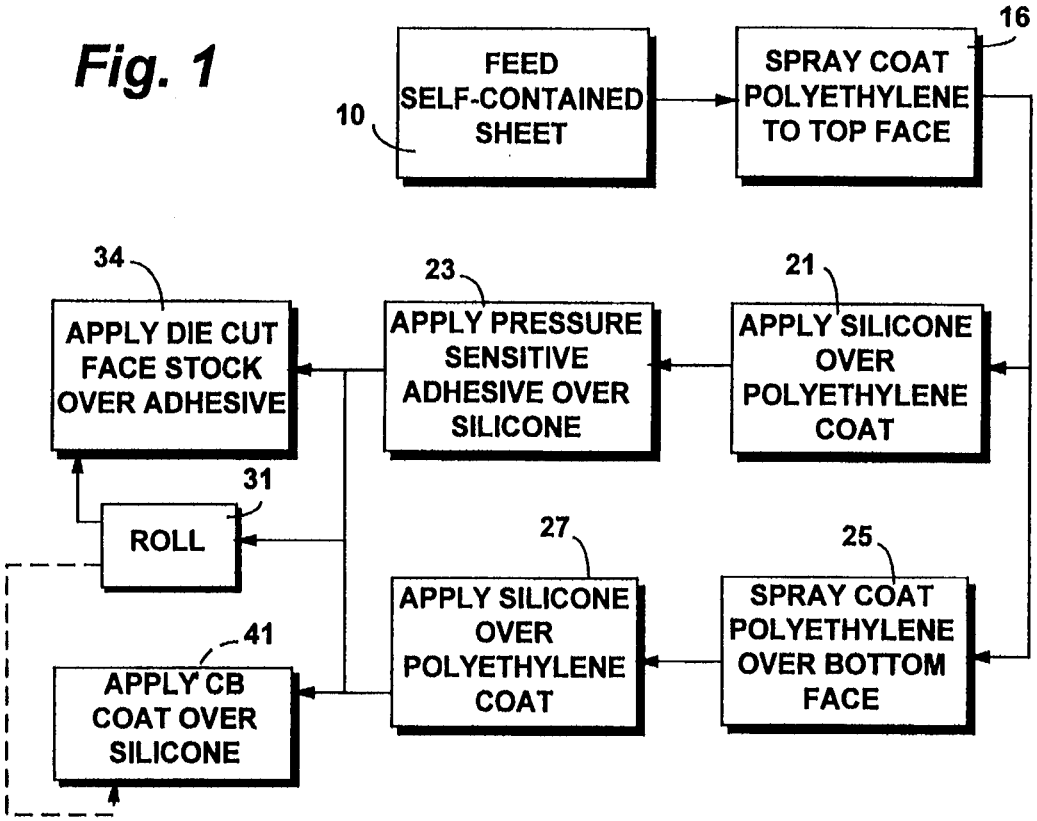
FIG. 1 is a schematic view showing exemplary methods of producing transfer tape and a business form according to the present invention.

FIG. 1 schematically illustrates various procedures for production of transfer tapes, and for a business form utilizing transfer tape, according to the present invention. The procedure is started by feeding a self-contained sheet, as illustrated generally by box 10 in FIG. 1, the self-contained sheet typically being Moore Business Forms MCP® paper, or NCR carbonless paper. The self-contained sheet is shown generally by reference numeral 11 in FIG. 2, comprising a base 12 of paper with self-imaging material 13 thereon, and having a first face 14 and a second face 15.

To the first face 14 there is applied a coating or film layer of polyethylene, as shown generally by reference numeral 16 in FIG. 1. The polyethylene 16 is preferably sprayed on as a coating, although it may be applied as a coating using other suitable techniques. While a coating is most desirous and advantageous, the polyethylene can alternatively be provided in film (film layer) form. The coating or film layer is typically about 1 mil or less in thickness, and while it may be of any suitable type it may be polyethylene material provided by Technicoat of Miamisburg, Ohio, or Jen Coat, Inc. of Westfield, Mass. The first coating or film layer of polyethylene is shown schematically at 17 in FIG. 2.

The first and second faces 14, 15 of the primary sheet 11 may be treated sequentially, or at the same time. That is all of the operations for one of the faces may be performed at one time, and then all of the operations for the other. FIG. 1, merely for simplicity sake, shows simultaneous treatment of the first and second faces 14, 15 of the primary sheet after the step 18.

To the first polyethylene coating or film layer 17 is applied a coating of silicone, illustrated schematically at 21 in FIG. 1. The silicone coating itself is illustrated schematically at 22 in FIG. 2, and preferably comprises a differential coating of silicone, that is one having two sides, one side having a stronger affinity for adhesive than the other side. For instance a 4–5 differential silicone may be applied with the "4" side in contact with the polyethylene coating or film layer 17 and with the "5" side facing away from the polyethylene coating or film layer 17, to which the adhesive is applied since the "5" side has less affinity for the adhesive than the "4" side.

To the silicone coating 22 the pressure sensitive adhesive is applied, as illustrated schematically at 23 in FIG. 1. The pressure sensitive adhesive—shown schematically at 24 in FIG. 2—may be of any suitable type, either permanent, repositional, removable, or the like. The two most common ways for applying the adhesive 24 in the step 23 are as a hot melt, or from a pre-wound tape. The hot melt adhesive is applied with a ribbon coater, while adhesive applied from the pre-wound tape is applied by bringing the pre-wound tape into face-to-face contact with the silicone coating 22, so that the adhesive 24 adheres thereto, and then winding up the tape and disposing of it.

To the second face 15, a spray coating or film layer of polyethylene is provided as illustrated schematically at 25 in FIG. 1. This polyethylene coating or film layer 26 (see FIG. 2) is essentially identical to and applied in essentially the identical manner to the coating or film layer 17. A second silicone coat is applied over the second polyethylene coat or film layer 26, as illustrated schematically at 27 in FIG. 1, the second silicone coat being shown schematically at 28 in FIG. 2.

Both the second silicone coat 28 and the first silicone coat 22 are preferably applied so that they have a weight of about 3–10 grams per square meter. Were the silicone coating is to be applied directly to the paper 11 rather than to the polyethylene coating, the silicone would have a tendency to soak into the paper 11 perhaps rendering it useless as carbonless/self-imaging paper.

Figure 2:
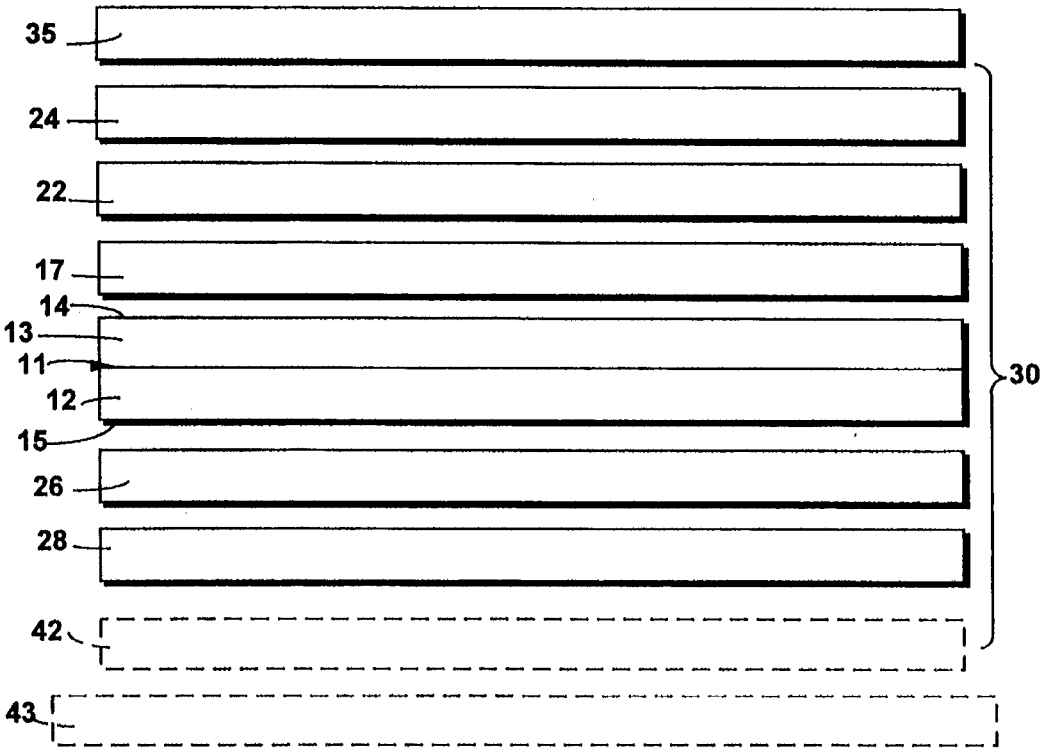
FIG. 2 is a side exploded view, with the components greatly exaggerated in thickness for clarity of illustration, of a piece of transfer tape according to the present invention, with a face stock and a CF sheet also shown in association therewith.

Once the transfer tape is constructed—the transfer tape being shown schematically at reference numeral 30 in FIG. 2—it may be wound into a roll configuration, as illustrated schematically at 31 in FIG. 1. The roll configuration itself is illustrated schematically at 32 in FIG. 3, with the pressure sensitive adhesive 24 in contact with the second silicone coating 28 in the spiral roll configuration. Alternatively, the transfer tape 30 may be run in lengths and automatically cut into those lengths, or may be cut into small segments to be applied as liner backed labels. In FIG. 1 the stage illustrated schematically at 34 indicates applying the transfer tape in lengths to face stock, the face stock being shown schematically at 35 in FIG. 2, to form business forms such as shown in U.S. Pat. No. 5,129,682. The face stock 35 is die cut to form individual labels, as illustrated schematically at 34 in FIG. 1, which labels are self-imaging. FIG. 4 schematically illustrates a label 37 formed from the face stock 35 which will have the pressure sensitive adhesive 24 on the bottom face thereof, and shows it with an image 38 imprinted thereon. That image 38 is also transferred—as indicated by reference numeral 39 in FIG. 4—to the underlying remaining transfer tape 30 (all of the components illustrated in FIG. 2 except for the adhesive 24, which adheres to the face stock 35), with the transfer tape 30 providing a record copy of the image 38/39.

According to another modification of the invention, a conventional CB coating is applied to the second coating 28. This is illustrated schematically at 41 in FIG. 1, the CB coating being shown at 42 in FIG. 2. When the CB coating 42 is then applied over a CF coated sheet 43 (see FIG. 2) the image 38 transferred onto the face stock 35 will also not only transfer as indicated at 39 in FIG. 4 to the self-contained sheet 11, but will also transfer to the CF sheet 43.

It will thus be seen that according to the present invention a self-imaging transfer tape, business form constructed thereby, and method of construction thereof, have been provided which are simple yet effective. While the invention has been herein shown and described in what is presently conceived to be the most practical and preferred embodiment thereof it will be apparent to those of ordinary skill in the art that many modifications may be made thereof within the scope of the scope of the invention, which scope is to be accorded the broadest interpretation of the appended claims so as to encompass all equivalent structures and methods.

What is claimed is:

1. A transfer tape, comprising:

a carbonless, self-contained primary sheet having first and second faces;

a first polyethylene coating, or polyethylene film layer, of about 1 mil thick, or less, on said first face;

a first silicone coating over said first polyethylene coating or film layer;

a pressure sensitive adhesive coating on said first silicone coating;

a second polyethylene coating, or polyethylene film layer, of about 1 mil thick, or less, on said second face; and a second silicone coating over said second polyethylene coating or film layer.

2. A transfer tape as recited in claim 1 wherein said first and second polyethylene coatings are present.

3. A transfer tape as recited in claim 2 consisting of said primary sheet, first and second polyethylene coatings, first and second silicone coatings, and pressure sensitive adhesive.

4. A transfer tape as recited in claim 3 in a roll configuration with said adhesive engaging said second silicone coating.

5. A transfer tape as recited in claim 1 in a roll configuration with said adhesive engaging said second silicone coating.

6. A transfer tape as recited in claim 1 wherein said first silicone coating is a differential coating having a first side having a stronger affinity for adhesive than a second side, and wherein said second side of said differential silicone coating engages said pressure sensitive adhesive.

7. A transfer tape as recited in claim 1 further comprising a CB coating on said second silicone coating.

8. A transfer tape as recited in claim 1 wherein each of said silicone coatings has a weight of about 3–10 grams per square meter.

9. A transfer tape as recited in claim 1 wherein said adhesive is hot melt adhesive or adhesive from a pre-wound tape.

10. A transfer tape as recited in claim 1 wherein said first silicone coating is a differential coating having a first side having a stronger affinity for adhesive than a second side, and wherein said second side of said differential silicone coating engages said pressure sensitive adhesive; and further comprising a CB coating on said second silicone coating; and wherein each of said silicone coatings has a weight of about 3–10 grams per square meter.

11. A business form comprising a face stock and a transfer tape with pressure sensitive adhesive engaging said face stock, said transfer tape comprising: a carbonless, self-contained primary sheet having first and second faces; a first polyethylene coating, or polyethylene film layer, of about 1 mil thick, or less, on said first face; a first silicone coating over said first polyethylene coating or film layer; said pressure sensitive adhesive coating on said first silicone coating; a second polyethylene coating, or polyethylene film layer, of about 1 mil thick, or less, on said second face; and a second silicone coating over said second polyethylene coating or film layer.

12. A business form as recited in claim 11 wherein said first and second coatings are present.

13. A business form as recited in claim 11 consisting of said primary sheet, first and second polyethylene coatings or film layers, first and second silicone coatings, face stock, and pressure sensitive adhesive.

14. A business form as recited in claim 11 wherein said first silicone coating is a differential coating having a first side having a stronger affinity for adhesive than a second side, and wherein said second side of said differential silicone coating engages said pressure sensitive adhesive, and wherein each of said silicone coatings has a weight of about 3–10 grams per square meter.

15. A business form as recited in claim 11 further comprising a CB coating on said second silicone coating.

16. A business form as recited in claim 11 further comprising a plurality of labels die cut out of said business form base stock where it overlies said transfer tape.

17. A business form as recited in claim 11 wherein said adhesive is hot melt adhesive or adhesive from a pre-wound tape.

18. A business form as recited in claim 11 wherein said first silicone coating is a differential coating having a first side having a stronger affinity for adhesive than a second side, and wherein said second sided of said differential silicone coating engages said pressure sensitive adhesive; and further comprising a CB coating on said second silicone coating; and wherein each of said silicone coatings has a weight of about 3–10 grams per square meter.

* * * * *